US008925359B2

(12) United States Patent
Frankel

(10) Patent No.: US 8,925,359 B2
(45) Date of Patent: Jan. 6, 2015

(54) SECURITY DOOR BRACE SYSTEM AND METHOD OF USE THEREOF

(76) Inventor: Jordan Frankel, Atlanta, GA (US)

( * ) Notice: Subject to any disclaimer, the term of this patent is extended or adjusted under 35 U.S.C. 154(b) by 790 days.

(21) Appl. No.: 12/708,442

(22) Filed: Feb. 18, 2010

(65) Prior Publication Data

US 2011/0011137 A1 Jan. 20, 2011

Related U.S. Application Data

(63) Continuation-in-part of application No. 29/340,314, filed on Jul. 16, 2009, now Pat. No. Des. 612,717.

(51) Int. Cl.
*E05B 35/08* (2006.01)
*E05C 19/18* (2006.01)
*E05B 63/00* (2006.01)

(52) U.S. Cl.
CPC ..... *E05C 19/184* (2013.01); *E05B 63/0004* (2013.01); *Y10S 292/15* (2013.01)
USPC ..... 70/338; 292/DIG. 15; 16/82

(58) Field of Classification Search
USPC ..... 292/1, DIG. 15; 70/338; 16/82
See application file for complete search history.

(56) References Cited

U.S. PATENT DOCUMENTS

| | | | | |
|---|---|---|---|---|
| 1,082,432 | A | | 12/1913 | Mertsheimer |
| 1,445,810 | A | | 2/1923 | Weichman |
| 1,667,771 | A | | 5/1928 | Chiapparelli |
| 2,929,647 | A | | 3/1960 | Gladstone |
| 3,330,585 | A | | 7/1967 | Pollin |
| 3,833,963 | A | | 9/1974 | Waters |
| 3,977,714 | A | | 8/1976 | Trotter |
| 4,178,026 | A | | 12/1979 | Sinkhorn |
| 4,303,266 | A | | 12/1981 | Volpi |
| 4,343,500 | A | | 8/1982 | Steiner |
| D270,234 | S | * | 8/1983 | Shuster ..... D8/402 |
| 4,462,623 | A | | 7/1984 | Grant |
| 4,601,502 | A | | 7/1986 | Van Dyke |
| 4,797,970 | A | | 1/1989 | Cahrlton |
| 5,018,241 | A | | 5/1991 | Baines |
| 5,029,911 | A | | 7/1991 | Daniels |
| D323,778 | S | | 2/1992 | Roman |
| 5,120,093 | A | | 6/1992 | Carney |
| 5,163,308 | A | | 11/1992 | Lillo |
| D331,696 | S | | 12/1992 | Graham |
| 5,197,407 | A | | 3/1993 | Sims |
| 5,199,759 | A | | 4/1993 | Anderson |
| 5,207,026 | A | | 5/1993 | Bozeman, Jr. |
| 5,226,201 | A | * | 7/1993 | Lefebvre ..... 16/86 A |
| 5,283,254 | A | | 2/1994 | Cozzi et al. |
| D346,956 | S | * | 5/1994 | Wigley, Sr. ..... D8/402 |
| 5,383,254 | A | | 1/1995 | Wigley, Sr. |
| 5,395,143 | A | | 3/1995 | Chesterton |
| 5,454,143 | A | | 10/1995 | Wigley, Sr. |
| 5,454,610 | A | * | 10/1995 | Taylor et al. ..... 292/339 |
| 5,490,304 | A | | 2/1996 | Winner, Jr. et al. |
| 5,531,490 | A | | 7/1996 | Parker |

(Continued)

*Primary Examiner* — Mark Williams
(74) *Attorney, Agent, or Firm* — Baker & Hostetler LLP

(57) ABSTRACT

A security door brace is provided for bearing against an inside surface of a barrier door in order to prevent non-permitted, inward opening of the door. The security door brace carries one or more elongated pin means for cooperative engagement with one or more slotted receiving means formed within a cooperating mounting plate that is firmly affixed, preferably via conventional screw fastener means, to a portion of the floor underlying the intended operable position of the security door brace.

20 Claims, 3 Drawing Sheets

(56) References Cited

U.S. PATENT DOCUMENTS

| | | | | |
|---|---|---|---|---|
| 5,590,918 | A | 1/1997 | Kambalov | |
| 5,618,072 | A | 4/1997 | Pitchford | |
| 5,727,822 | A * | 3/1998 | Truong | 292/202 |
| 5,755,582 | A | 5/1998 | Charlton | |
| 5,775,746 | A | 7/1998 | Charlton | |
| 5,873,273 | A | 2/1999 | Vick | |
| 5,983,680 | A | 11/1999 | Del Nin | |
| 6,041,473 | A | 3/2000 | Johnson | |
| D442,473 | S | 5/2001 | Habeck et al. | |
| 6,336,245 | B1 | 1/2002 | Sakakibara | |
| 6,340,185 | B1 * | 1/2002 | Truong | 292/339 |
| 6,378,917 | B1 | 4/2002 | Jones | |
| 6,397,645 | B1 * | 6/2002 | Grant, Jr. | 70/202 |
| 6,467,125 | B1 * | 10/2002 | Johnson | 16/82 |
| 6,557,912 | B1 * | 5/2003 | Truong | 292/338 |
| 6,572,160 | B2 | 6/2003 | Bunting | |
| D552,981 | S | 10/2007 | Yamaguchi | |
| D570,670 | S | 6/2008 | Clemens | |
| 7,393,027 | B1 * | 7/2008 | Chen | 292/342 |
| D602,339 | S * | 10/2009 | Frankel | D8/343 |
| 7,651,140 | B2 * | 1/2010 | Leggio | 292/288 |
| 2007/0077117 | A1 * | 4/2007 | Vu et al. | 403/401 |

* cited by examiner

SECURITY DOOR BRACE SYSTEM AND METHOD OF USE THEREOF

RELATED APPLICATION

The present United States Non-provisional Utility Patent Application is a continuation-in-part of, and hereby claims priority to, and the full benefit of, U.S. Design patent application Ser. No. 29/340,314, filed on Jul. 16, 2009, now U.S. Pat. No. D612,717, issued Mar. 30, 2010, entitled "Security Door Brace", the disclosure of which is incorporated herein by reference.

TECHNICAL FIELD

The present invention relates generally to security devices directed to preventing a door from opening; and, more specifically, to a security door brace and cooperating mounting plate system, the door brace for bearing against an inside surface of a door in order to prevent inward opening thereof, and to related methods of use.

BACKGROUND

It has become apparent in modern times that, on average, communities are becoming increasingly unsafe. As community safety declines, so, too, does individual safety. This is borne out by national statistics showing that home invasion and breaking-and-entering type crimes are increasing at alarming rates, especially in large cities.

For example, current statistics demonstrate that one of every five homes will experience a break-in or violent home invasion. Up to eighty percent of break-ins occur forcibly through a locked door. Over seventy percent of burglaries occur while families are at home. Thirty-eight percent of assaults, and sixty percent of rapes, occur during home invasions. These are sobering statistics, indeed.

In many ways, breaking-and-entering crimes are among the most humiliating, intrusive, costly, and affronting. Home invasion crimes, on the other hand, wherein an intruder will kick-in the front door of a home with the intent to take hostages, injure family members, and commit criminal acts against persons and property, are heinous and devastating. Most haunting are statistics that home invasion crimes are most frequently committed during daytime hours, at times when the individual or family least expects such an attack and may be least prepared to defend against one.

As such crimes increase, individuals and families grow ever more concerned about their personal safety, and the safety of their homes and possessions. Regardless of whether one is home or away at the time of commission of the crime, no one wants to confront a forced entry into their personal and private space. Further, it is especially true that no-one wants to be the victim of a home invasion.

Similar concerns may sometimes arise with regard to some types of office and commercial properties. These are easy, and sometimes frequent, targets due to the number of nighttime and, often, weekend hours that such properties are left unattended. Other factors, such as the relative solitude of a business within a commercial district after business hours, may also provide increased opportunity for commission of a forced entry crime.

Of even greater concern is that an employee may be on-premises, conducting authorized after-hours business, at the time a forced entry crime is being committed. Not only are business owners concerned for their personal safety, and the safety of their employees and patrons, but they are also concerned about the significant economic liabilities that can arise in the nature of legal claims against the business, brought by persons who were on-premises at the time of the forced entry crime.

Although of lesser significance when compared to the above-described concerns, regardless of whether the subject property is a home or business, a forced entry crime inevitably results in significant property damage at the point of entry, and often within the property itself, which subsequently requires costly repairs. Furthermore, in circumstances wherein there is property damage, property loss, and/or personal injuries that result from a forced entry crime, insurance claims are often brought. As a consequence, individual and aggregate premiums rise due to increased policy holder payouts and increasing insurable risk.

As a result of the above-described concerns and considerations, individuals, families, businesses, and insurers will go to great lengths to prevent an unlawful, unwanted entry. Most often, in order to prevent a forced entry, one or more locks are installed upon or within an outward facing, barrier door and its casing. Such locks may take the form of simple locks, bolt-type locks, door-to-casing pins, bars, high security locks, chains, or the like. Even though one or more such locks may be correctly installed, functional, and in-use, a forced entry may still be committed.

For example, doors may be kicked-in, knocked-in, or pried open; the locks forced, the chains cut. Additionally, and most prevalent with regard to residential doors, the door hinges may fail under an outside impact-type assault on the door, providing an unintended opening opposite the otherwise locked side. Most frequently, the door frame itself will fail from an outside impact, splintering and separating from the deadbolt, and allowing entry.

Although one or more alarms may be installed and activated, they provide little to no actual, physical protection against a forced entry. While an alarm may serve as a potential deterrent, law enforcement response times may not be sufficient to ensure safety of person and property. Additionally, alarms that are not remotely monitored by an owner or third-party service provider often go unnoticed, unheeded, and unreported; thereby, reducing or obviating any possible deterrent effect.

Thus, it is only by keeping unwanted persons out of a private space by actually preventing their physical entry, that personal safety, and the safety of property within, truly may be ensured.

Against the backdrop described above, it would be desirable, therefore, to provide a practically impenetrable security door brace and cooperating mounting plate system that prevents inward opening of a barrier door, and to related methods of use. It would be preferable for such a system to be relatively inexpensive, yet effective and easy to use; thereby, encouraging use of the system in order to obtain a desirable result and benefit in the form of increased safety and security against unwanted, forced entry. Accordingly, it is to these purposes that the present disclosure is directed.

SUMMARY

According to its major aspects and broadly stated, in a preferred embodiment, the present invention overcomes the above-mentioned disadvantages and meets the recognized need for such a system and method by providing a security door brace for bearing against an inside surface of a barrier door in order to prevent non-permitted, inward opening of the door. The security door brace is insertable into a cooperating mounting plate that is firmly affixed, preferably via conventional screw fastener means, to a portion of the floor underlying the intended operable position of the security door brace.

In a preferred embodiment, the security door brace is provided with a handle means and with longitudinal gripping means, both of which may provide for ease of carrying, handling, and manipulation of the security door brace in accordance with its intended use.

The security door brace further carries one or more elongated pin means for cooperative engagement with one or more slotted receiving means formed within the mounting plate. The mounting plate is thin enough to be positioned below the bottom edge of the door, so that opening of the door is unimpeded when the security door brace is not in position; yet deep enough to provide secure and complete penetration of the elongated pin means within the mounting plate.

The security door brace may be provided with bumper means to absorb the kinetic energy of an invasion attempt and to prevent marring of an abutting door surface. Additionally, the security door brace may be provided with regions for appropriate surface clearance, in order to further prevent marring of an abutting door surface. The security door brace and mounting plate surfaces may be appropriately contoured for pleasing appearance and feel.

The security door brace and mounting plate are preferably constructed of a material that is lightweight, yet is strong, tough, and durable; that is water, rot, and mildew resistant; that will not mar the finish of the door during ordinary use; that is maintenance free; and that will not unduly wear through repeated use cycles of engaging the security door brace into, and disengaging it from, its mounting plate.

In assemblage and use of such an embodiment, the security door brace and mounting plate is set in a preferred, predetermined position against the inward surface of a barrier door. The mounting plate is affixed into position upon the floor, preferably via screws penetrating the mounting plate through holes provided for such purposes. The security door brace may, thereafter, repeatedly be set into and removed from the mounting plate through engagement or disengagement, as appropriate, of the cooperating elongated pin and slot means.

When properly positioned, installed, and used, the security door brace and associated mounting plate means effectively prevent unwanted opening of the barrier door, even though the door may be pried, battered, kicked, rammed, pummeled, or forced from the outside. In fact, a remarkable magnitude of external force may be safely withstood through use of the present system and associated methods.

Thus, a plurality of objects, features, and advantages are recognized and obtained by proper construction, operation, and use of the present security door brace system and associated methods of use. For example, by proper construction, installation, operation, and use of the present security door brace system and associated methods, unwanted persons may be kept out of a private spaces by actually preventing their physical entry through a barrier door. Accordingly, personal safety, and the safety of property within, may be better assured.

When in place, practically impenetrable by means of outside force, the security door brace and cooperating mounting plate system of the present invention prevents inward opening of a barrier door. Such a system may be made relatively inexpensively, yet is effective, lightweight, maintenance free, and easy to use; thereby, encouraging use of the system in order to obtain desirable results and benefits in the form of increased safety and security against unwanted, forced entry of intruders into personal or private spaces.

These and other objects, features, and advantages of the present inventive subject matter will become more apparent to those ordinarily skilled in the art after reading the following Detailed Description and Claims in light of the accompanying drawing Figures.

BRIEF DESCRIPTION OF THE DRAWINGS

Accordingly, the present invention will be understood best through consideration of, and reference to, the following Figures, viewed in conjunction with the Detailed Description of the Preferred Embodiment referring thereto, in which like reference numbers throughout the various Figures designate like structure and in which.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF ILLUSTRATIVE EMBODIMENTS

In describing preferred embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

In that form of the preferred embodiment of the present invention chosen for purposes of illustration, FIGS. 1-8 show security door brace and mounting plate system 10. Security door brace 20 and cooperating mounting plate 30 are preferably constructed with consideration to certain characteristics described more fully hereinbelow.

Figure 1:
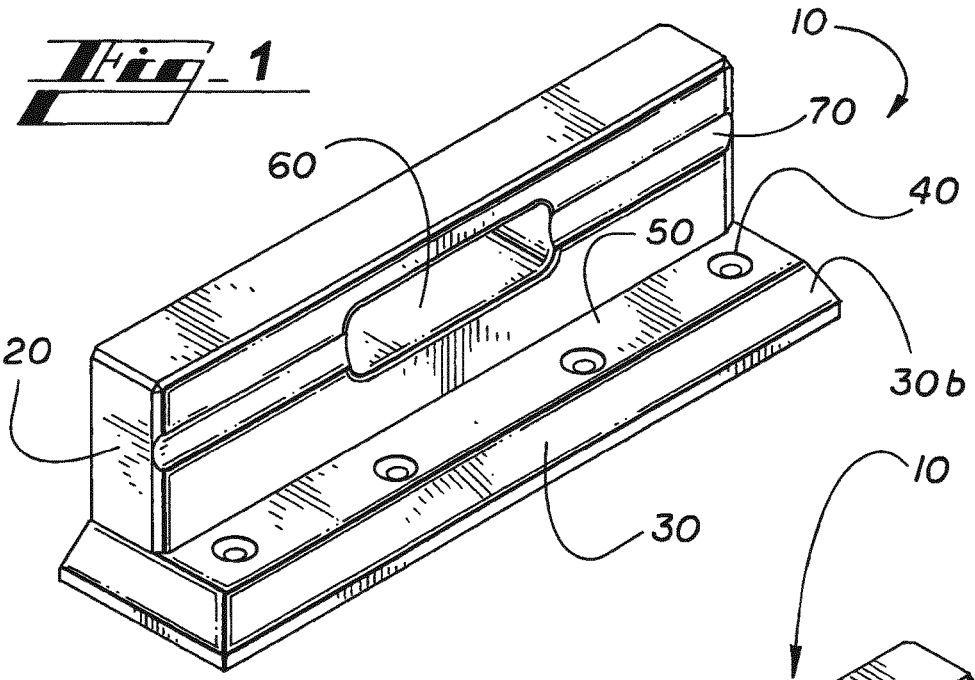
FIG. 1 is a perspective view of the security door brace and cooperating mounting plate system of a preferred embodiment of the present invention.
Figure 5:
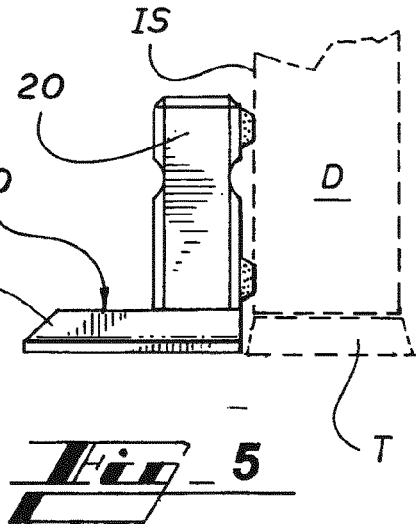
FIG. 5 is a right elevation view of the security door brace and cooperating mounting plate system of a preferred embodiment of the present invention, as shown in FIG. 1.
Figure 7:
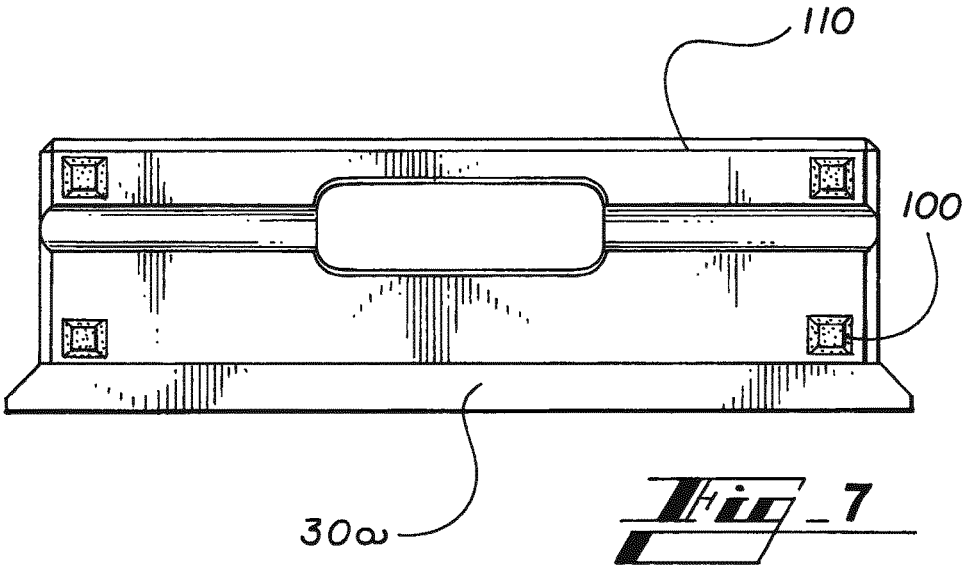
FIG. 7 is a rear elevation view of the security door brace and cooperating mounting plate system of a preferred embodiment of the present invention, as shown in FIG. 1; and, FIG. 8 is a bottom view of the security door brace and cooperating mounting plate system of a preferred embodiment of the present invention, as shown in FIG. 1.

Best seen with reference to FIGS. 1 and 5, security door brace 20 is intended for use and application in bearing against an inside surface IS of barrier door D in order to prevent non-permitted, inward opening of door D. Security door brace 20 is insertable into cooperating mounting plate 30.

Mounting plate 30 is firmly affixed, preferably via conventional screw fastener means inserted through holes 40 disposed within mounting plate 30, to a portion of the floor underlying an intended operable position of security door brace 20. For purposes described below, holes 40 are preferably countersunk with respect to top surface 50 of mounting plate 30. Screw fastener means are selected in sufficient length to accommodate a thickness of mounting plate 30 and an additional, appropriate penetration distance into the floor. Screw fastener means are also preferably utilized which have flat, tapered heads, matching a profile of countersunk holes 40, in order to rest at or below a top surface 50 of mounting plate 30, so that the heads of the screw fastener means do not interfere with proper operation of door D, and do not pose a trip hazard. Additionally, anodized screw fastener means preferably are used in order to reduce rust or corrosion of the fastener that often occurs at a barrier door due to the proximity of, and contact with, environmental moisture.

It is noted that holes 40 may be provided in a plurality of positions in order to provide appropriate gripping strength and shear force resistance in the assemblage. In that regard, holes 40 may be disposed in a pattern along top surface 50, for example, two forward and two rearward, so that a single line of force is not set-up within the floor. Such a pattern reduces potential for splitting any underlying floor boards through application of screw force, and reduces potential for detrimental single line splitting, shearing, and/or overturning moments within the assemblage during an outside assault on door D.

In a correctly installed position, mounting plate 30 may abut, or nearly abut, a door threshold T of conventional design, such as might typically be utilized as a barrier to entry of dirt, moisture, rainwater, snow, outside air, or the like, under door D. Accordingly, mounting plate 30 preferably is provided with flat rearward surface 30*a*.

In a preferred embodiment, security door brace 20 is provided with handle means 60 and with longitudinal gripping means 70, both of which may provide for ease of carrying, handling, and manipulation of security door brace 20 in accordance with its intended use. In these regards, handle means 60 preferably passes through security door brace 20 so that it is accessible from either side. To these same ends, longitudinal gripping means 70 are provided, preferably, along both front and back of security door brace 20, and in approximately similar positions. That is, handle means 60 and longitudinal gripping means 70 are preferably symmetrical in location and configuration as between front and back sides of security door brace 20.

Figure 2:
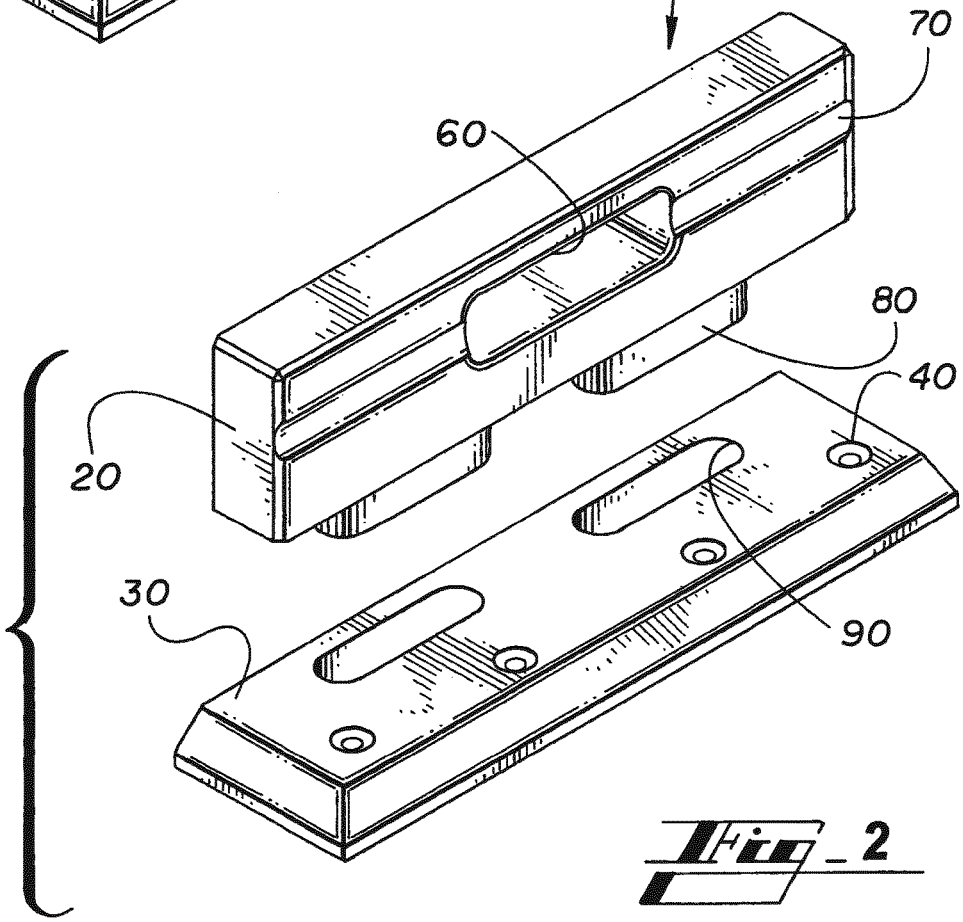
FIG. 2 is an exploded perspective view of the security door brace and cooperating mounting plate system of a preferred embodiment of the present invention, as shown in FIG. 1.
Figure 3:
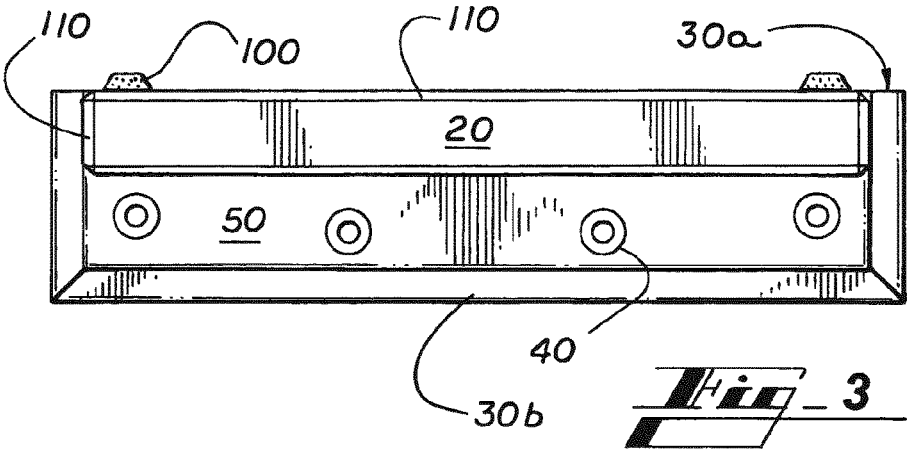
FIG. 3 is a top view of the security door brace and cooperating mounting plate system of a preferred embodiment of the present invention, as shown in FIG. 1.
Figure 4:
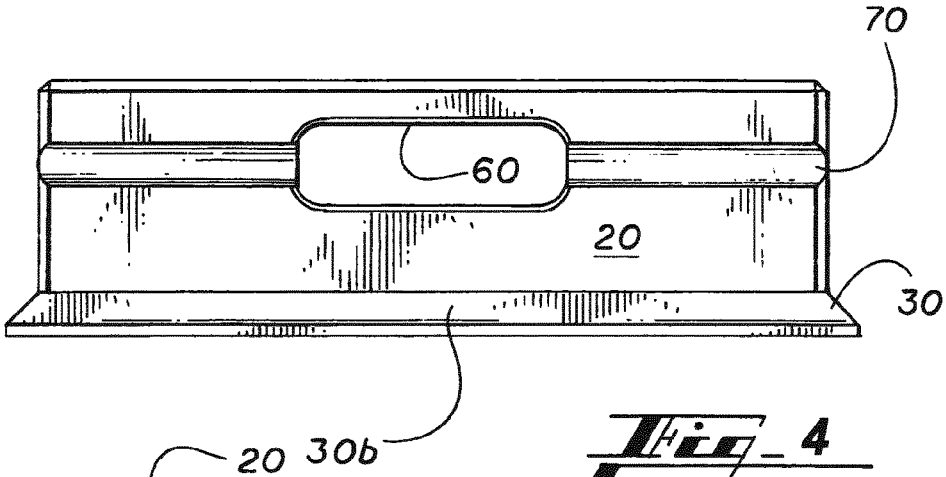
FIG. 4 is a front elevation view of the security door brace and cooperating mounting plate system of a preferred embodiment of the present invention, as shown in FIG. 1.
Figure 6:
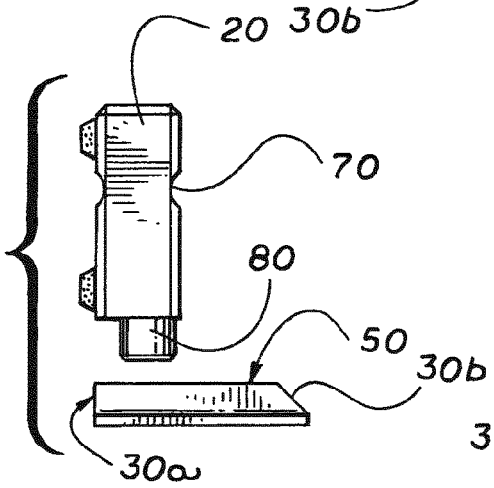
FIG. 6 is an exploded left elevation view of the security door brace and cooperating mounting plate system of a preferred embodiment of the present invention, as shown in FIG. 1.
Figure 8:
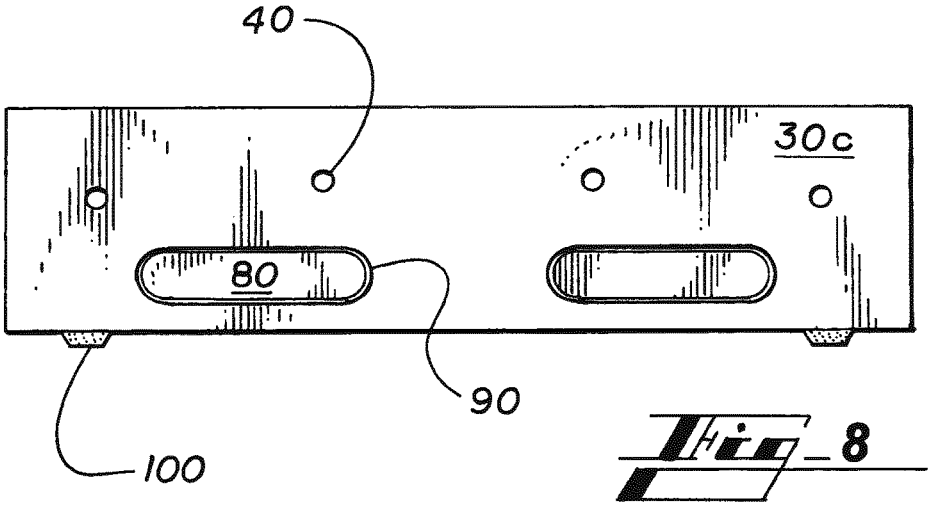

Best seen with reference to FIGS. 2, 6 and 8, security door brace 20 further carries one or more elongated pin means 80 for cooperative engagement with one or more slotted receiving means 90 formed within mounting plate 30. As discussed above, mounting plate 30 is thin enough to be positioned below a bottom edge of door D, so that opening of door D is unimpeded when security door brace 20 is not in position; yet is thick enough to provide secure and complete penetration of elongated pin means 80 within mounting plate 30. An additional and advantageous benefit of such construction is that, even were an intruder to attempt to reach with fingers, tools, or prying means under door D, and through the weather stripping that is often present to close the gap under a door, security door brace 20 is not susceptible of being pried or pushed out of engagement with mounting plate 30.

In some embodiments, security door brace 20 may be provided with bumper means 100, and with regions for appropriate surface clearance and for smoothness to touch, such as chamfered edges 110, in order to prevent marring of an abutting door surface. Additionally, bumper means 100 preferably comprises a vulcanized rubber material, which advantageously absorbs a portion of the kinetic energy of an intrusion force; thereby, preventing the entirety of the force from being transferred into security door brace 20 and mounting plate 30. This energy absorption tends to increase stability of the assemblage and to reduce the chance of failure. Security door brace 20 and mounting plate 30 surfaces may be otherwise appropriately contoured for pleasing appearance, feel, and function.

For example, mounting plate 30 may be provided with one or more tapered surfaces 30*b* to reduce trip hazards and to provide an associated, wider mounting plate bottom surface 30*c*. A wider mounting plate bottom surface, such as bottom surface 30*c*, provides for stronger and more secure attachment to the floor, for flexibility in establishing an appropriate screw fastener means pattern, as discussed above, and for better frictional characteristics of the assemblage.

Although it is common in the industry to utilize metals, such as steel, brass, and aluminum, for security mechanisms, security door brace 20 and mounting plate 30 of the present invention are preferably constructed of a non-metallic material that is lightweight, yet is strong, tough, and durable; that is water, rot, and mildew resistant; that will not mar the finish of door D during ordinary use; that is maintenance and lubrication free; and that will not unduly wear through repeated use cycles of engaging security door brace 20 into, and disengaging it from, mounting plate 30.

In that regard, and although metals and metal alloys can be used in some embodiments of the present invention, it has been found preferable to use materials comprising polypropylene sulfide reinforced with glass fiber. Such materials meet the above preferred characteristics, and may be formed through molding, injection molding, and extrusion-type processes. Accordingly, a preferred material meeting the aforedescribed characteristics is PPS-A604+40% GF. Such material is reinforced with approximately 40% glass fiber, providing strength and durability characteristics in the finished parts.

Advantageously, and unlike metal materials that might be used for fabrication of the present invention, polypropylene sulfide materials are maintenance free; will not oxidize or degrade in moist environments, such as often arise near a barrier door; and do not require the use of a lubricant to prevent wear between mating surfaces, or to provide for ease of assembly and use. In fact, the use of a lubricant is detrimental and to be avoided, if at all possible, in the intended environment of use of the present invention for the reason that a lubricant can capture and retain grit, sand, dirt, and the like, which will, in turn, gouge, wear, and otherwise degrade cooperating metal parts. Additionally, it is so burdensome upon a user to periodically clean and relubricate metal parts to reduce this degradation, that it will rarely, if ever, be done. Thus, use of polypropylene sulfide materials in association with the present invention is advantageous and preferred.

In assemblage and use of the present invention, security door brace 20 and mounting plate 30 are set in a preferred, predetermined position against the inward surface IS of barrier door D. Mounting plate 30 is affixed into position upon the floor, preferably via screws penetrating mounting plate 30 through holes 40 provided for such purposes. Security door brace 20 may, thereafter, repeatedly be set into, and removed from, mounting plate 30 through engagement or disengagement, as appropriate, of cooperating elongated pin means 80 and slotted receiving means 90.

When properly positioned, installed, and used, security door brace and mounting plate system 10 effectively prevent unwanted opening of barrier door D, even though door D may be pried, battered, kicked, rammed, pummeled, or forced from the outside. In fact, a remarkable magnitude of external force has been shown to be safely withstood through use of security door brace and mounting plate system 10, and those associated methods of installation and use thereof set forth hereinabove.

Thus, a plurality of objects, features, and advantages are recognized and obtained by proper construction, operation, and use of the present security door brace and mounting plate system 10, and associated methods of installation and use. For example, by proper construction, installation, operation, and use of the present security door brace and mounting plate system 10 and associated methods, unwanted persons may be kept out of a private spaces by actually preventing their physical entry through barrier door D. Accordingly, personal safety, and the safety of property within, may be better assured.

When in place, security door brace and mounting plate system 10 becomes practically impenetrable by means of outside force. Accordingly, security door brace and mounting plate system 10 of the present invention prevents inward opening of barrier door D, while, at the same time, it may be made relatively inexpensive, lightweight, and easy to use; thereby, encouraging use of the system in order to obtain desirable results and benefits in the form of increased safety and security against unwanted, forced entry of intruders into personal or private spaces.

It will, of course, be appreciated by those of ordinary skill in the art that the elements, pieces, and parts of the invention described herein, and methods of affixation and use thereof, may be varied, reconfigured, and rearranged to meet the function, and achieve the benefits of, the present invention.

Thus, having described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed:

1. A security system for intended use in association with a barrier door, comprising:

(a.) a door brace carrying an elongate pin means at a bottom surface thereof, said elongate pin means being greater in a dimension running lengthwise with said door brace than in a dimension running across said door brace;

(b.) a mounting plate carrying a slotted receiving means through a top surface thereof, and providing a first and a second plurality of fastener holes for affixation of said mounting plate to a floor, said first and second plurality of fastener holes offset from said slotted receiving means, said first plurality of fastener holes further offset from said second plurality of fastener holes, said slotted receiving means being greater in a dimension running lengthwise with said mounting plate than in a dimension running across said mounting plate;

(c.) said elongate pin means cooperatively engageable with said slotted receiving means.

2. The security system of claim 1 wherein said elongate pin means comprises a plurality of elongate pin means.

3. The security system of claim 1 wherein said slotted receiving means comprises a plurality of slotted receiving means.

4. The security system of claim 1 further comprising screw fasteners disposed within said first and a second plurality of fastener holes for affixation of said mounting plate to the floor.

5. The security system of claim 1 wherein said mounting plate is provided with a flat rearward surface.

6. The security system of claim 1 wherein said door brace is provided with handle means.

7. The security system of claim 1 wherein said door brace is provided with a longitudinal gripping means.

8. The security system of claim 1 wherein said door brace is provided with bumper means.

9. The security system of claim 1 wherein said mounting plate is provided with a tapered front surface.

10. The security system of claim 1 wherein said door brace and mounting plate comprise polypropylene sulfide material.

11. The security system of claim 10 wherein said polypropylene sulfide material further comprises glass fiber.

12. The security system of claim 11 wherein said glass fiber comprises approximately 40% of said material.

13. A security door brace and mounting plate system for intended use with a barrier door, comprising:

(a.) a door brace comprising polypropylene sulfide reinforced with glass fiber, carrying an elongate pin means at a bottom surface thereof, said elongate pin means being greater in a dimension running lengthwise with said door brace than in a dimension running across said door brace;

(b.) a mounting plate comprising polypropylene sulfide reinforced with glass fiber, carrying a slotted receiving means through a top surface thereof, and providing a first and a second plurality of fastener holes for affixation of said mounting plate to a floor, said first and second plurality of fastener holes offset from said slotted receiving means, said first plurality of fastener holes further offset from said second plurality of fastener holes, said slotted receiving means being greater in a dimension running lengthwise with said mounting plate than in a dimension running across said mounting plate;

(c.) said elongate pin means cooperatively engageable with said slotted receiving means.

14. The security system of claim 13 wherein said elongate pin means and said slotted receiving means comprise, respectively, a plurality of elongate pin means and a plurality of slotted receiving means.

15. The security system of claim 13 wherein said mounting plate is provided with a flat rearward surface.

16. The security system of claim 13 wherein said door brace is provided with handle means.

17. The security system of claim 13 wherein said door brace is provided with a longitudinal gripping means.

18. The security system of claim 1 wherein said mounting plate is provided with a tapered front surface.

19. A method for use of a security system for intended use in association with a barrier door, the security system comprising:

(a.) a door brace carrying an elongate pin means at a bottom surface thereof, said elongate pin means being greater in a dimension running lengthwise with said door brace than in a dimension running across said door brace; a mounting plate carrying a slotted receiving means through a top surface thereof, and providing first and second means for affixation of said mounting plate to a floor, said first and second means for affixation of said mounting plate to a floor being offset from said slotted receiving means, said first means for affixation of said mounting plate to a floor further offset from said second means for affixation of said mounting plate to a floor, said slotted receiving means being greater in a dimension running lengthwise with said mounting plate than in a dimension running across said mounting plate; said elongate pin means cooperatively engageable with said slotted receiving means;

the method comprising:

(b.) setting said door brace into said mounting plate by aligning and downwardly engaging said elongate pin means of said door brace with said slotted receiving means of said mounting plate.

20. The method of claim 19 further comprising removal of said door brace from said mounting plate by upwardly disengaging said elongate pin means of said door brace from said slotted receiving means of said mounting plate.

* * * * *